United States Patent [19]

Högberg

[11] 4,092,705

[45] May 30, 1978

[54] METHOD OF ILLUMINATING AN OBJECT AND A DEVICE FOR CARRYING OUT THE METHOD

[75] Inventor: Karl Johan Falke Högberg, Uppsala, Sweden

[73] Assignee: Medical Products Octagon AB, Uppsala, Sweden

[21] Appl. No.: 600,038

[22] Filed: Jul. 29, 1975

Related U.S. Application Data

[63] Continuation of Ser. No. 511,862, Oct. 3, 1974, abandoned, which is a continuation of Ser. No. 400,572, Sep. 25, 1973, abandoned.

[30] Foreign Application Priority Data

Sep. 29, 1972 Sweden ..... 7212663

[51] Int. Cl.[2] ..... F21V 29/00

[52] U.S. Cl. ..... 362/294; 350/290; 352/202; 355/71

[58] Field of Search ..... 240/47, 1.4, 9 A; 350/290; 355/30, 71; 98/40 DL; 352/202

[56] References Cited

U.S. PATENT DOCUMENTS

| | | | |
|---|---|---|---|
| 3,180,981 | 4/1965 | Ulffers | 240/47 |
| 3,338,132 | 8/1967 | Ruhle et al. | 240/47 X |
| 3,841,743 | 10/1974 | Thevenaz | 352/198 |

*Primary Examiner*—R. L. Moses
*Attorney, Agent, or Firm*—Fred Philpitt

[57] ABSTRACT

An apparatus for illuminating an object including an arrangement of several reflectors which coact with a light screening body and a convex mirror to substantially absorb all the heat energy emitted by the light source while transmitting a maximum amount of visible light.

1 Claim, 3 Drawing Figures

Figure 2:
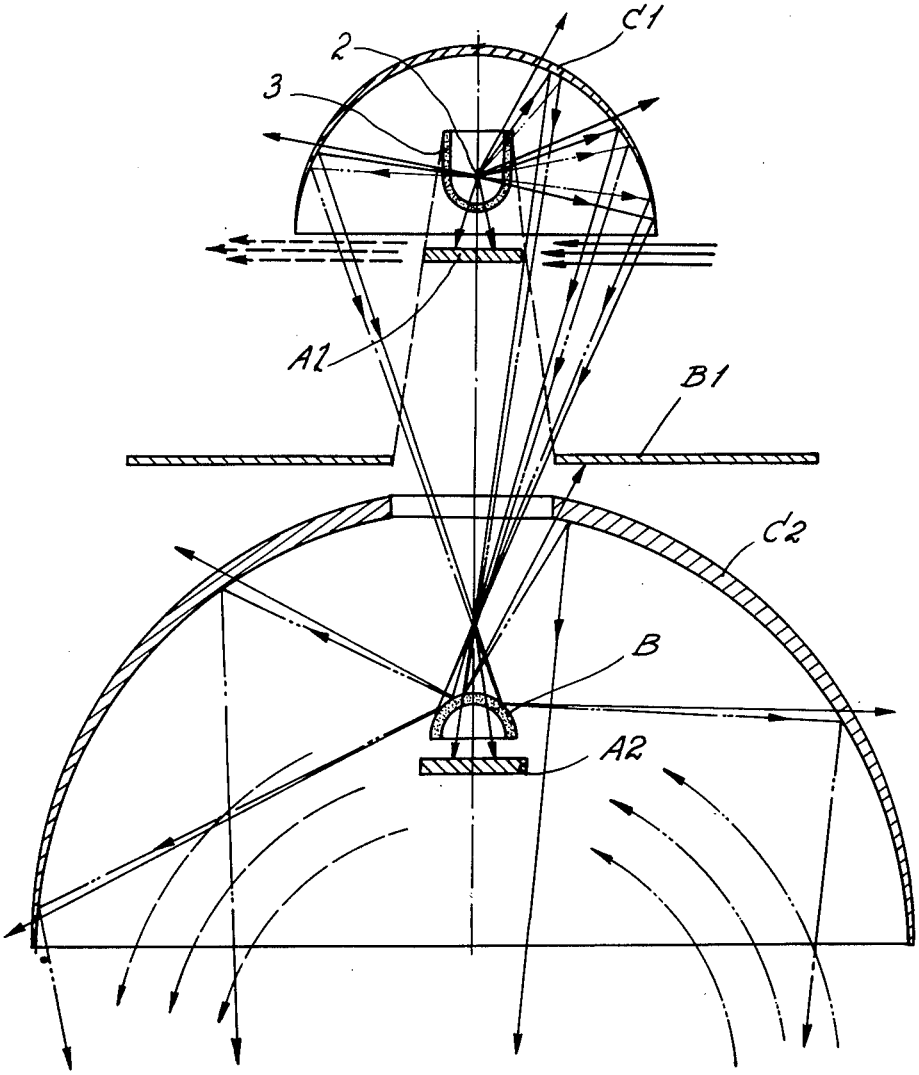

Fig. 1
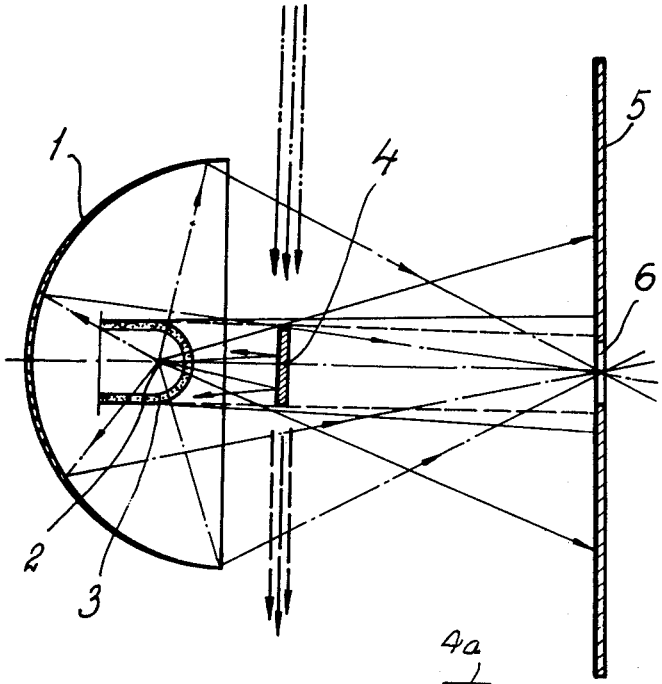
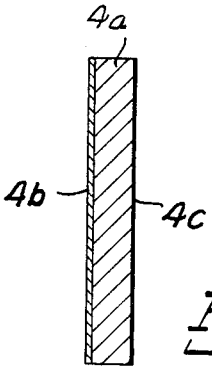
Fig. 1a

METHOD OF ILLUMINATING AN OBJECT AND A DEVICE FOR CARRYING OUT THE METHOD

This is a continuation of application Ser. No. 511,862 filed Oct. 3, 1974 which is in turn a cont. of Ser. No. 400,572 filed Sept. 25, 1973, both now abandoned.

The present invention relates to a method for illuminating objects by means of a lamp which includes a reflector and a light source connected therewith, said light source having a casing which also emits heat radiation. Examples of such light sources are electric filaments, electric arcs etc.

A disadvantage with methods of the type envisaged is that in addition to emitting radiation within the wave length region of visible light, the heat sources used also transmit heat radiation which, when absorbed by the object being illuminated or by objects nearby, generates heat, which can give rise to undesirable effects, such as causing increases in the temperature of sensitive material. The problem of heat radiation is apparent within the field of preparative microbiology, where heat radiation is liable to affect illuminated cells in an undesirable manner. Heat radiation from, for example, lamps in operating theatres may also make working conditions more unbearable, especially during warm weather.

The prime object of the present invention is to provide ways and means whereby this disadvantage is at least substantially overcome. The invention is mainly characterized in that the object or objects are screened from the heat radiation emitted directly from the light source by means of an element or body capable of absorbing radiant heat and that the heat generated in the body by such absorption is conducted away, the object or objects being substantially only impinged upon by radiation which has passed the reflector. The element capable of absorbing radiant heat may be arranged either outwardly of the defining plane of the reflector, as explained hereinafter, or inwardly of the same. In a special case the element may be arranged in the actual defining plane itself.

In accordance with one embodiment of the invention, the heat generated by the absorption body may be conducted away by a flowing medium, such as a flow of air, running liquid etc.

In accordance with another embodiment of the invention the heat generated by the absorption body as it absorbs radiant heat may be carried away through a metal body arranged in heat transfer contact with the absorption body.

In accordance with one feature of the invention, the visible light from the reflector is conveniently caused to pass through the opening in a shutter, baffle or like device, the shutter or like device being completely shielded from direct heat radiation from the light source and its casing by the absorption body.

In accordance with the invention, the light reflected by the reflector may be caused to pass through known devices, such as radiant heat absorption filters, radiant heat reflection filters, or through a combination of such filters, or so-called cold light reflecting mirrors to separate further radiant heat from the light reflected by the reflector.

In accordance with a special embodiment of the invention, radiant heat separated in a filter from light entering thereinto can be caused to impinge upon a second body capable of absorbing such radiation and the heat generated in said body as a result of such absorption conducted away. In accordance with another embodiment of the invention, the visible light from the light source can be caused to reflect from a reflecting coating on the radiant heat absorbing body to the reflector.

The invention also relates to a device for carrying out the inventive method as defined above. A device for this purpose includes a lamp having a reflector and a light source with casing cooperating with said reflector. The device is characterized in that a body capable of absorbing radiant heat is arranged in front of the light source, separated therefrom, in a manner such as to shield the object of objects being illuminated from direct heat radiation from the light source, so that heat generated as a result of the absorption of radiant heat in the body can be conducted away, e.g. by means of a flowing medium.

Materials from which such bodies can be made are well known in physics. Examples of such materials include copper, aluminium, etc.

With a device constructed according to the invention, the body capable of absorbing radiant heat can be arranged outwardly of a plane passing through the defining edges of the reflector, hereinafter referred to as the reflector defining plane, inwardly of said plane or actually on the plane.

In accordance with the invention, the body capable of absorbing radiant heat can be arranged in heat transfer contact with a metal body able to conduct away the heat generated by radiation.

In accordance with the invention, the device may have a shutter provided with an opening which is completely screened from heat radiations direct from the light source and its casing by the absorption body.

A device constructed in accordance with the invention can be included in a multiple arrangement having a plurality of spherical so-called cold light mirrors. Such an arrangement can be installed in operating theatres as part of the lighting system. A device constructed for this purpose in accordance with the invention is mainly characterized by an additional, larger reflector having arranged therein a convex mirror which reflects light reflected by the first reflector to the reflecting coating of the larger reflector, and by a further body capable of absorbing radiant heat arranged in cooperative relationship with the convex mirror.

The invention will now be described in more detail with reference to two embodiments of a device constructed in accordance therewith and shown diagrammatically in the accompanying drawings. In the drawings FIG. 1 is a diagrammatic view of a device constructed according to the principle on which the invention is based, and FIG. 1*a* is an enlarged sectional view of the screening body of FIG. 1;

FIG. 2 shows a more complex arrangement incorporating the device shown in FIG. 1, the arrangement being suitable for installation in an operating theatre.

With the embodiment shown in FIG. 1, there is provided a bowl-shaped reflector 1, the inner surface of which is coated with a reflecting coating which may optionally be pervious to radiant heat (so-called cold light coating). Arranged in the reflector 1 is a light source comprising an electric filament 2 and a surrounding quartz glass casing 3. The light source is so arranged in relation to the focus of the reflector 1 that light emitted by the light source and reflected by the reflector is directed to a point located outwardly of the open part of the reflector. Radiant heat is emitted from the light source 2 and the casing 3 together with radiations within the wave length area of visible light. To prevent radiant heat from affecting objects illuminated by the visible light reflected from the light source 2, a screening body 4 capable of absorbing radiant heat is arranged outwardly of the outer defining plane of the reflector 1. As is shown in FIG. 1*a*, the body 4 is made of stainless steel 4*a* and has blackening 4*c* on its surface remote from the reflector. On the side of the body 4 facing the reflector 1, the body 4 is provided with a reflecting coating 4*b* which reflects visible light towards the inside of the reflector. The illustrative device is also provided with a shutter 5 having an opening 6 arranged to let through visible light from the reflector 1. The dimensions of the shutter opening are such that the body 4 fully screens off the light source 2 and the casing 3. No radiant heat, or at least only insignificant amounts of radiant heat passes through the opening 6. A minor portion of the radiant heat from the light source 2 is reflected by the body 4 back onto the inner surfaces of the reflector 1, where only a very minor portion of the radiation is re-reflected back while the remainder is absorbed by the reflector walls. As will be evident from the aforegoing, the majority of the heat radiation from the light source 2 and the casing 3 is absorbed by the body 4. To remove the heat generated in the body 4, there is provided a fan (not shown) which is arranged to blow a stream of air across the body as shown at 7. The device shown in FIG. 1 forms an effective producer of "cold light" and can be used for many purposes where it is important that the illuminated object is not affected by radiant heat.

FIG. 2 shows diagrammatically an arrangement suitable for use in operating theatres. In the Figure, the reference C1 indicates a reflector having a cold-light reflecting coating (heat transmission mirror). Similar to the device described with reference to FIG. 1, there is arranged in the reflector C1 a light source having a quartz glass casing 3, the light source 2 also in this case being screened off by means of an absorption body A1 capable of absorbing heat radiation from the light source. Light reflected from the reflector C1, which light may still contain minor quantities of heat radiation, is caused to pass through a shutter or baffle B1 and is directed to a point located within the confines of a larger reflector C2, as shown in the Figure. Arranged behind the reflector C2 is a convex spherical mirror B which has a coating of a substance which is pervious to heat radiation but which reflects visible light, this light being reflected onto the inner surface of the reflector C2, from where it is reflected out into the operating theatre, for example, to give the desired illumination. The reflector C2 may also be provided with a heat transmitting surface which is pervious to heat radiation. The heat radiation passing through mirror B is caused to impinge on a second absorption body A2, from which the heat generated therein is led away by means of a stream of air which passes into and out of the reflector C2.

The described arrangement filters out the major part of the heat radiation emitted by the light source, thereby maintaining a comfortable temperature in the room where the arrangement is installed.

What I claim is:

1. In an apparatus for illuminating an object, including a light source which emits energy including visible light and radiant heat, and a first reflector disposed in spaced relationship with respect to said object to be illuminated, the improvement comprising: a screening body disposed between said light source and said object to be illuminated and in the path of direct transmission of said emitted energy from said light source to said object to be illuminated, said screening body preventing substantially all of said emitted energy from directly reaching said object to be illuminated by reflecting substantially all of said visible light, following said path of direct energy transmission, back to said first reflector and absorbing substantially all of said radiant heat, following said path of direct energy transmission, heat transmission means operatively associated with said screening body to lead said heat absorbed by said screening body out of said path of direct energy transmission, said light source being spatially disposed between said reflector and said screening body, a convex, second, larger reflector, having an aperture therein sufficiently large to pass reflected energy from said first reflector, disposed between the screening body and the object to be illuminated and oriented with its concave surface thereof facing said object to be illuminated, a convex mirror disposed within said second reflector with its convex surface receiving said reflected energy from said first reflector to reflect substantially all of the visible light of said reflected energy, and an absorption body disposed in said path of said reflected energy between said convex mirror and said object to be illuminated to absorb substantially all of the heat energy of said reflected energy.

* * * * *